US011168535B2

(12) United States Patent
Saeed

(10) Patent No.: US 11,168,535 B2
(45) Date of Patent: Nov. 9, 2021

(54) SINGLE-SET ANTI-EXTRUSION RING WITH 3-DIMENSIONALLY CURVED MATING RING SEGMENT FACES

(71) Applicant: Exacta-Frac Energy Services, Inc., Conroe, TX (US)

(72) Inventor: Ahmed Mohamed Saeed, Cypress, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 130 days.

(21) Appl. No.: 16/561,385

(22) Filed: Sep. 5, 2019

(65) Prior Publication Data

US 2021/0071494 A1 Mar. 11, 2021

(51) Int. Cl.
*E21B 33/12* (2006.01)
*E21B 33/129* (2006.01)

(52) U.S. Cl.
CPC ..... *E21B 33/1216* (2013.01); *E21B 33/1293* (2013.01)

(58) Field of Classification Search
CPC ..... E21B 33/128–12955
See application file for complete search history.

(56) References Cited

U.S. PATENT DOCUMENTS 3,283,820 A * 11/1966 Tausch ..... E21B 33/1295 166/120
3,587,736 A 6/1971 Brown
6,598,672 B2 7/2003 Bell et al.
7,214,831 B2 5/2007 Lan-Hargest et al.
8,047,279 B2 11/2011 Barlow et al.
8,113,276 B2 2/2012 Greenlee et al.
8,567,492 B2 10/2013 White
8,955,605 B2 2/2015 VanLue
8,997,853 B2 4/2015 VanLue
9,010,411 B1 4/2015 VanLue
9,074,439 B2 6/2015 VanLue
9,157,288 B2 10/2015 Martinez
9,316,806 B2 4/2016 VanLue
9,334,703 B2 5/2016 VanLue
9,416,617 B2 8/2016 Wiese et al.
9,631,453 B2 4/2017 VanLue
9,677,356 B2 6/2017 Rochen
9,719,320 B2 8/2017 VanLue
9,725,918 B2 8/2017 Young et al.
9,725,982 B2 8/2017 VanLue
9,698,228 B2 9/2017 VanLue
9,759,029 B2 9/2017 Davies et al.
9,845,656 B2 12/2017 Zimmerman et al.
10,294,749 B2 5/2019 Rochen
2002/0043368 A1* 4/2002 Bell ..... E21B 33/1216 166/118
2009/0255690 A1 10/2009 Conner et al.
2012/0097384 A1 4/2012 Valencia et al.
2016/0097253 A1 4/2016 Ruffo et al.

* cited by examiner

*Primary Examiner* — Kristyn A Hall
(74) *Attorney, Agent, or Firm* — J. Bennett Mullinax, LLC

(57) ABSTRACT

A single-set anti-extrusion ring has a plurality of ring segments with a mating face on each end. Each mating face has a 3-dimensionally curved topology and the first mating face is a mirror image of the second mating face so the ring segments fit together to form and anti-extrusion ring without gaps in an unexpanded condition, and no straight path through the anti-extrusion ring in an expanded condition.

15 Claims, 5 Drawing Sheets

SINGLE-SET ANTI-EXTRUSION RING WITH 3-DIMENSIONALLY CURVED MATING RING SEGMENT FACES

FIELD OF THE INVENTION

This invention relates in general to single-set anti-extrusion rings used for non-retrievable downhole pressure isolation packers for cased wellbores, such as frac plugs and, in particular, to a single-set anti-extrusion ring with 3-dimensionally curved mating ring segment faces.

BACKGROUND OF THE INVENTION

Packers for isolating fluid pressures in cased well bores are well known in the art. Many such packers are single-set packers that are not retrievable from the well bore. One example of a single-set packer is a "frac plug", used to isolate fracturing fluid pressure during hydrocarbon well completion operations. Single-set packers, once set, can only be removed from the well bore by drilling out the packer using a drill bit on a tubing work string. Frac plugs are subjected to extreme fluid temperatures and pressures, which can cause the packing element(s) of those packers to extrude and lose their fluid sealing contact with the well bore casing. Anti-extrusion inhibitors help control packer element extrusion and maintain the packer element in sealing contact with the well bore casing. Anti-extrusion rings have proven to be effective anti-extrusion inhibitors. Various configurations for anti-extrusion rings are known in the art. While anti-extrusion rings are known, the most effective ones require complex interlocking parts that are expensive to construct and assemble.

There therefore exists a need for a novel single-set anti-extrusion ring that is simple to construct and assemble and is very effective as a packer element extrusion inhibitor.

SUMMARY OF THE INVENTION

It is therefore an object of the invention to provide a novel single-set anti-extrusion ring with 3-dimensionally curved mating ring segment faces.

The invention therefore provides an anti-extrusion ring for a main sealing element of a non-retrievable packer, comprising a plurality of ring segments held together by a fracture ring that is designed to fracture when the anti-extrusion ring is expanded as the packer is shifted from a run-in condition to a packer-set condition, each ring segment having two ring segment mating faces, each ring segment mating face having a 3-dimensionally curved topology, a first of the mating faces being a mirror image of a second of the mating faces, so that the ring segments fit together to form an anti-extrusion ring without gaps in the run-in condition.

The invention further provides a single-set anti-extrusion ring for a main sealing element of a non-retrievable packer comprising a plurality of ring segments that are substantially V-shaped in cross-section and have a rectangular ring segment notch in a top surface thereof, the respective ring segments being held together by a fracture ring that is received in the ring segment notch and designed to fracture when the anti-extrusion ring is expanded as the packer is shifted from a run-in condition, to a packer-set condition, each ring segment having two ring segment mating faces, each ring segment mating face having a 3-dimensionally curved topology, a first of the mating faces being a mirror image of a second of the mating faces, so that the ring segments fit together to form an anti-extrusion ring without gaps in the run-in condition.

The invention yet further provides a composite frac plug, comprising: a composite mandrel with a central passage, the composite mandrel further having an up-hole end and a downhole end with a mandrel hub on the up-hole end, and an end sub securely affixed to the downhole end; an elastomeric gripper assembly mounted to the mandrel, the elastomeric gripper assembly having an insert groove with a plurality of circumferentially spaced-apart inserts that bite and grip a casing of a cased wellbore when the composite frac plug is in a set condition; a main sealing element downhole of the elastomeric gripper assembly; an anti-extrusion ring downhole of the main sealing element, the anti-extrusion ring comprising a plurality of ring segments that are substantially V-shaped in cross-section and have a rectangular ring segment notch in a top surface thereof, the respective ring segments being held together by a fracture ring that is designed to fracture when the anti-extrusion ring is expanded as the composite frac plug is shifted from a run-in condition to a set condition, each ring segment having two ring segment mating faces, each ring segment mating face having a 3-dimensionally curved topology, a first of the mating faces being a mirror image of a second of the mating faces, so that the ring segments fit together to form an anti-extrusion ring without gaps in the run-in condition; a slip hub having an anti-extrusion cone downhole of the main sealing element and a slip cone downhole of the anti-extrusion cone; and a slip assembly downhole of the slip hub, the slip assembly comprising a plurality of slips adapted to slide up the slip cone to bite and grip the casing of the cased wellbore when the composite frac plug is shifted from the run-in condition to the set condition.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a novel single-set anti-extrusion ring having 3-dimensionally curved mating ring segment faces for non-retrievable downhole packers, such as frac plugs. The 3-dimensionally curved ring mating segment faces are particularly effective for inhibiting packer element extrusion under high temperature and fluid pressure conditions, because they provide no straight path for pressurized elastomeric packer material to extrude. The ring segments are readily constructed from rigid plastic, metal or composite material using injection molding, casting, composite tape laying or 3-D printing techniques well known in the art.

The ring segments are held together by a pre-scored fracture ring that is designed to fracture as the anti-extrusion ring is expanded from the run-in to the packer-set condition. An elastomeric O-ring overlays the fracture ring. The O-ring stabilizes the 3-dimensionally curved ring segments after the fracture ring fractures during the packer setting operation, and provides a back-up seal to the packer sealing element when it contacts the well casing in the packer-set condition. If the packer is later drilled out of the cased well bore, the ring segments fall away and provide no resistance to the drill bit, which facilitates the drilling operation.

PARTS LIST

| Part No. | Part Description |
|---|---|
| 10 | Anti-extrusion ring |
| 12 | Ring segments |
| 12a | Top left ring segment |
| 12b | Top right ring segment |
| 12c | Bottom left ring segment |
| 12d | Bottom right ring segment |
| 13a, 13b | Ring segment mating faces |
| 14 | Ring segment nadir |
| 16 | Ring segment top surface |
| 18 | Ring segment notch |
| 20 | Fracture ring |
| 22 | Elastomeric ring |
| 24 | Fracture scores |
| 26 | Shallow V-shaped curve |
| 28 | Shallow S-shaped curve |
| 30, 30a | Composite frac plugs |
| 32 | Composite mandrel |
| 34 | Composite mandrel hub |
| 36 | Composite mandrel passage |
| 38 | Shear screw bores |
| 40 | Gauge load ring |
| 42 | Gauge load ring retainer pins |
| 44 | Elastomeric gripper assembly |
| 46 | Elastomeric gripper assembly groove |
| 48 | Ceramic inserts |
| 50 | Main sealing element |
| 52 | Slip hub |
| 54 | Slip cone |
| 56 | Anti-extrusion cone |
| 58 | Slip hub retainer pins |
| 60 | Slip assembly |
| 62 | Slip retainer bands |
| 64 | Composite slips |
| 66 | Ceramic slip inserts |

-continued

PARTS LIST

| Part No. | Part Description |
|---|---|
| 68 | Lower end sub |
| 70 | Lower end sub retainer pins |
| 72 | Frac ball |
| 74 | Sliding cone |

Figure 1:
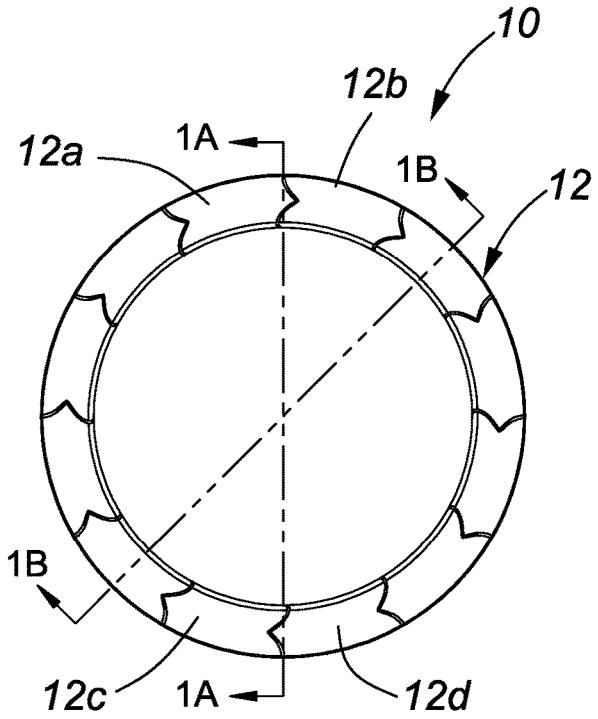
FIG. 1 is a side elevational view of an embodiment of a single-set anti-extrusion ring having 3-dimensionally curved mating, ring segment faces in accordance with the invention, in an unexpanded or "run-in" condition.

FIG. 1 is a side elevational view of an embodiment of a single-set anti-extrusion ring 10 having 3-dimensionally curved mating ring segment faces in accordance with the invention, in an unexpended or "run-in" condition. The anti-extrusion ring 10 is constructed using a plurality of identical ring segments 12 that are V-shaped in cross-section (see FIG. 1A).

Figure 1C:
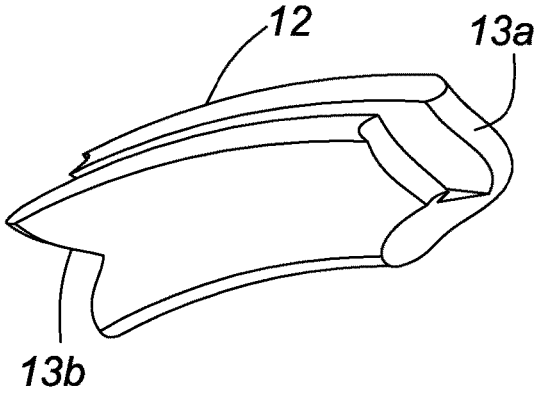
FIG. 1C is a perspective view of one ring segment of the anti-extrusion ring shown in FIG. 1.
Figure 1A:
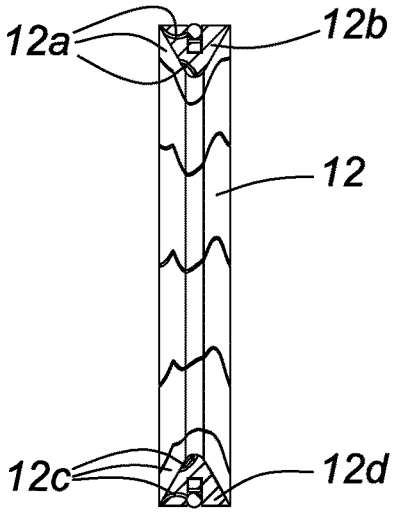
FIG. 1A is a cross-sectional view of the single-set anti-extrusion ring taken along lines 1A-1A of FIG. 1.

FIG. 1A is a cross-sectional view of the single-set anti-extrusion ring 10 taken along lines 1A-1A of FIG. 1. As can be seen in this view, due to the 3-dimensional curves of mating ring segment faces which will be explained below in more detail with reference to FIG. 1C, any straight radial line drawn through a segment mating face interface will intersect ring segments 12 on each side of the mating face interface. Thus, along the line 1A-1A of FIG. 1, most of the mating face of top left ring segment 12*a* is hidden by top right ring segment 12*b*, and most of bottom left ring segment 12*c* is hidden by bottom right ring segment 12*d*.

Figure 1B:
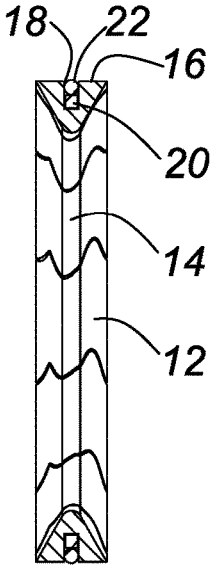
FIG. 1B is a cross-sectional view of the single-set anti-extrusion ring taken along lines 1B-1B of FIG. 1.

FIG. 1B is a cross-sectional view of the single-set anti-extrusion ring 10 taken along lines 1B-1B of FIG. 1. As can be seen, each ring segment 12 is V-shaped in cross-section with a rounded ring segment nadir 14. Each ring segment 12 also has an axially-flat ring segment top surface 16 with, a rectangular ring segment notch 18 that accommodates a fracture ring 20 overlaid by an elastomeric ring 22, for example an O-ring, FIG. 1C is a perspective view of one ring segment 12 of the anti-extrusion ring 10 shown in FIG. 1, As explained above, each ring segment 12 has mating faces 13*a*, 13*b* having a 3-dimensionally curved topology. Mating face 13*b* is a mirror image of mating face 13*a*, so that the respective ring segments 12 fit together to form the anti-extrusion ring 10 without gaps in the run-in condition. The 3-dimensionally curved mating faces 13*a*, 13*b* obviate any straight path across the anti-extrusion ring in the packer-set condition, which has proven to significantly improve the inhibition of a packer element extrusion under extreme fluid pressures. As explained above, the ring segments 12 are readily constructed from rigid plastic, metal or composite material using injection molding, casting, composite tape laying or 3-D printing techniques, all of which are well known in the art.

Figure 2:
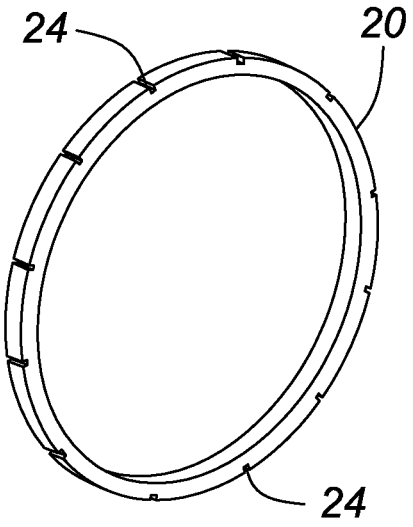
FIG. 2 is a perspective view of a fracture ring component of the single-set anti-extrusion ring shown in FIG. 1.

FIG. 2 is a perspective view of one embodiment of the fracture ring 20 component of the single-set anti-extrusion ring 10 shown in FIG. 1. In this embodiment the fracture ring 20 is substantially square in cross-section and has a top surface that is axially scored by a plurality of spaced-apart fracture scores 24, to facilitate and control a fracture of the fracture ring 20 as the single-set anti-extrusion ring 10 expands from the run-in condition to the packer-set condition. The shape and number of fracture scores 24 is a matter of design choice. In one embodiment, the fracture ring 20 is made of a rigid plastic and the fracture scores 24 are square notches cut in a top surface of the fracture ring 20. One simple way of assembling the anti-extrusion ring 10 is by supporting the fracture ring 20 above a flat surface while sequentially pushing the respective ring segments 12 outwardly from within the fracture ring 20 until the fracture ring 20 is within the ring segment notch 18 of each ring segment 12. As will be understood by those skilled in the art, the last ring segment 12 must be inserted at an angle with respect to a radial plane of the fracture ring 20 to accomplish this.

Figure 3:
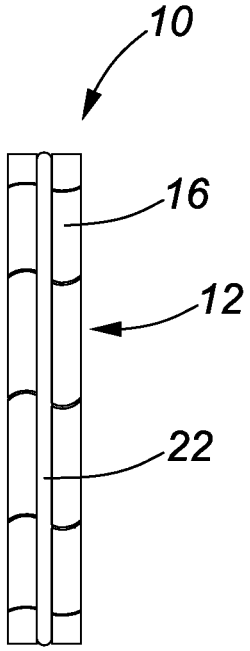
FIG. 3 is an edge elevational view of the single-set anti-extrusion ring shown in FIG. 1.

FIG. 3 is an edge elevational view of the single-set anti-extrusion ring 10 shown in FIG. 1, showing the elastomeric ring 22 that overlies the fracture ring 20 shown in FIG. 2.

Figure 4:
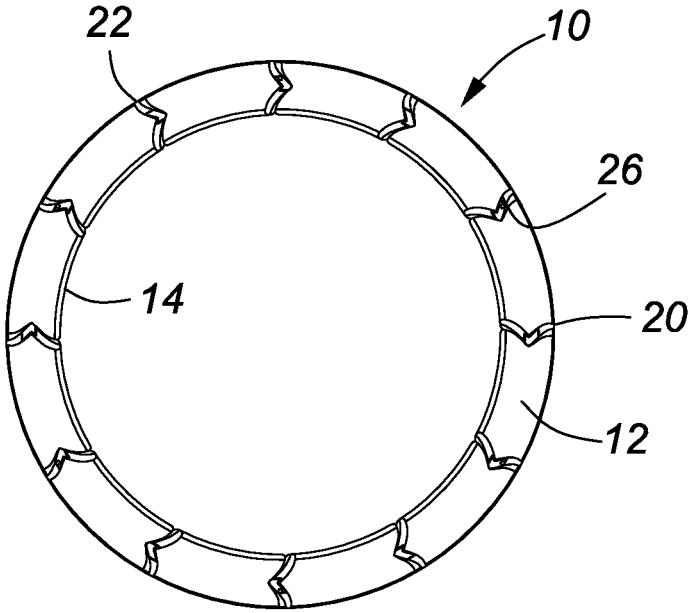
FIG. 4 is a side elevational view of the single-set anti-extrusion ring shown in FIG. 1, in an expanded or "packer-set" condition.

FIG. 4 is a side elevational view of the single-set anti-extrusion ring 10 shown in FIG. 1, in the expanded or "packer-set" condition. As can be seen, in the packer-set condition, there is no straight-line path through the single-set anti-extrusion ring 10 due to the 3-dimensionally curved mating faces 13*a*, 13*b* (see FIG. 1C) of the respective ring segments 12. In one embodiment, in a side aspect of the anti-extrusion ring 10, the mating faces 13*a*, 13*b* have a substantially shallow V-shaped curve 26, though the shape of this curve is a matter of design choice.

Figure 5:
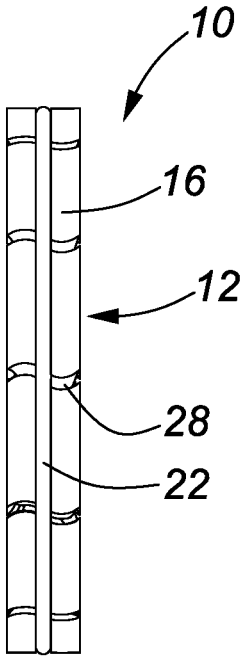
FIG. 5 is an edge elevational view of the single-set anti-extrusion ring shown in FIG. 4.

FIG. 5 is an edge elevational view of the single-set anti-extrusion ring shown 10 in FIG. 4. As can be seen, in an edge aspect the mating faces 13*a*, 13*b* have a substantially shallow S-shaped curve 28, though the shape of this curve is also a matter of design choice. As explained above, in one embodiment the mating faces 13*a*, 13*b* of the ring segments 12 have respective 3-dimensional topographies that reflect the respective 2-dimensional curves 26, 28 respectively seen in the side aspect, and the edge aspect of the anti-extrusion ring 10. However, it should be understood that the shape of either 2-dimensional curve may change in traverse of the mating faces 13*a*, 13*b*.

Figure 6:
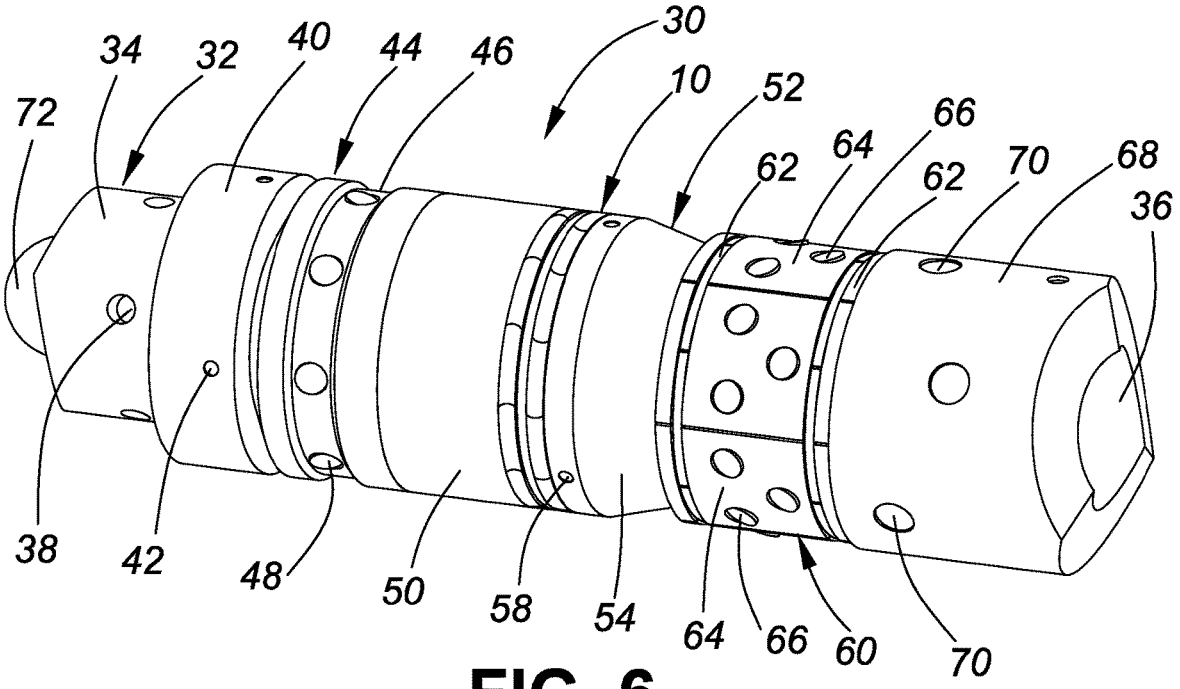
FIG. 6 is a perspective view of a frac plug equipped with the single-set anti-extrusion ring shown in FIG. 1, in a run-in condition.

FIG. 6 is a perspective view of a composite frac plug 30 equipped with the single-set anti-extrusion ring 10 shown in FIG. 1, in the run-in condition. The composite frac plug 30 is one embodiment of composite frac plugs and a method of setting same described in detail in Applicant's U.S. patent application Ser. No. 15/935,163 entitled Composite Frac Plug, which was filed on Mar. 26, 2018, the entire specification of which is incorporated herein by reference.

The composite frac plug 30 has a composite mandrel 32 with a composite mandrel hub 34. A composite mandrel passage 36 provides fluid communication through an entire length of the composite mandrel 30. Shear screw bores 38 in the composite mandrel hub 34 receive shear screws (not shown) that connect the composite frac plug 30 to a frac plug setting sleeve (not shown) that is in turn connected to a surface-located wireline selling tool (a Baker style size 20, for example, not shown) used to set the composite frac plug 30 in a manner well known in the art and explained in detail in Applicant's above-referenced patent application. A gauge load ring 40 downhole of the composite mandrel hub 34 is connected to the composite mandrel 32 by gauge load ring preset retainer pins 42. The gauge load ring preset retainer pins 42 secure the gauge load ring 40 in the run-in position shown in FIG. 6 until the composite frac plug 30 is pumped down to a desired location in a wellbore. The gauge load ring preset retainer pins 42 shear when the composite frac plug 30 is shifted from the run-in condition to a packer set condition, as explained in Applicant's patent application referenced above. Downhole of the gauge load ring 40 is an elastomeric gripper assembly 44 with a circumferential elastomeric gripper assembly groove 46. Circumferentially distributed in the elastomeric gripper assembly groove 46 are a plurality of ceramic inserts 48 designed to bite and grip a well casing when the composite frac plug 30 is moved to the packer set condition shown in FIGS. 7 and 7A. In the run-in condition shown FIG. 6, the ceramic inserts 48 are recessed within the elastomeric gripper assembly groove 46 and do not contact a casing of a cased well bore.

Adjacent a downhole side of the elastormeric gripper assembly 44 is an elastomeric main sealing element 50. The main sealing element 50 provides a high-pressure seal against a well casing (not shown) when the composite frac plug 30 is in the packer set condition. Adjacent a downhole side of the main sealing element 50 is the anti-extrusion ring 10, described in detail above. The anti-extrusion ring 10 inhibits extrusion of the main sealing element 50 when the composite frac plug 30 is in the packer set condition and subjected to high fluid pressures. Adjacent a downhole side of the anti-extrusion ring 10 is a slip hub 52. The slip hub 52 is secured to the composite mandrel 32 by slip hub retainer pins 58, which shear when the composite frac plug 30 is shifted from the run-in condition to the packer set condition. The slip hub 52 provides a slip cone 54 for a slip assembly 60 that, in this embodiment, is a frangible slip assembly that includes six composite slips 64 that are bound together by slip retainer bands 62 while the frac plug 30 is in the run-in condition. In one embodiment each composite slip 64 includes three ceramic slip inserts 66. Adjacent a lower end of the slip assembly 60 is a lower end sub 68. The lower end sub 68 is secured to the lower end of the composite mandrel 32 by lower end sub retainer pins 70 arranged in two staggered rows. A frac ball 72 inhibits fluid flow through the central passage 36 of the composite mandrel 32 while the composite frac plug 30 is being pumped down a cased well bore and while the composite frac plug is pressure isolating a well bore zone being stimulated using fracturing fluid, for example.

Figure 6A:
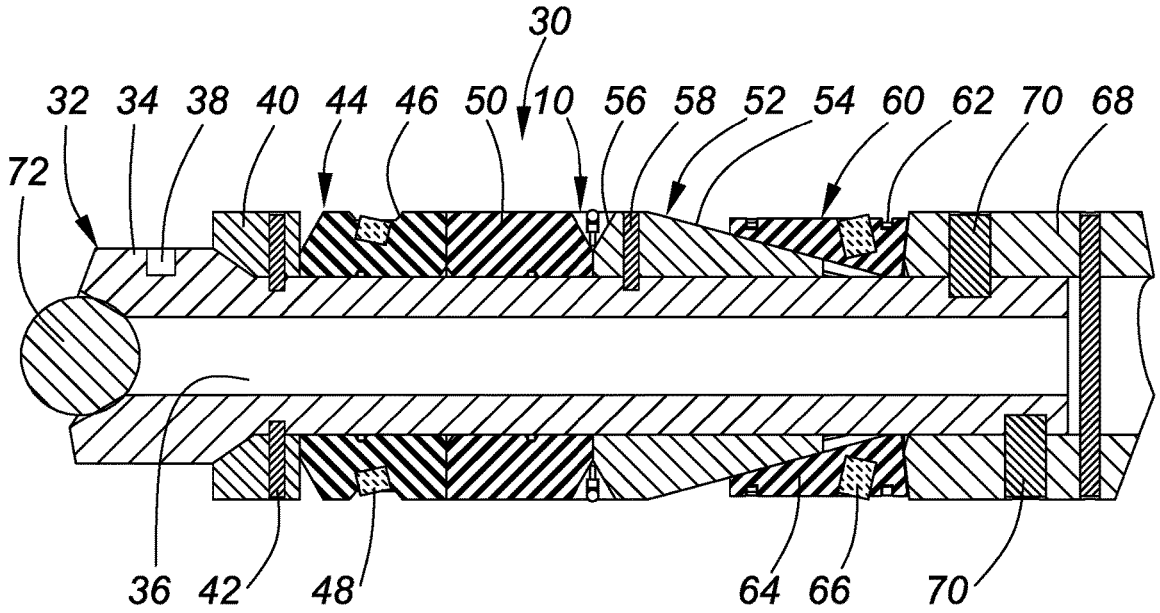
FIG. 6A is a cross-sectional view of the frac plug shown in FIG. 6, in the run-in condition.

FIG. 6A is a cross-sectional view of the composite frac plug 30 shown in FIG. 6, in the run-in condition. All of the elements of the composite frac plug 30 have been described above, except an anti-extrusion cone 56 on an uphole end of the slip hub 52. The anti-extrusion cone 56 supports a downhole side of the anti-extrusion ring 10 and urges the anti-extrusion ring 10 to the expanded condition shown in FIGS. 4 and 5 when the composite frac plug 30 is shifted to the packer set condition, as will be explained below with reference to FIG. 7A.

Figure 7:
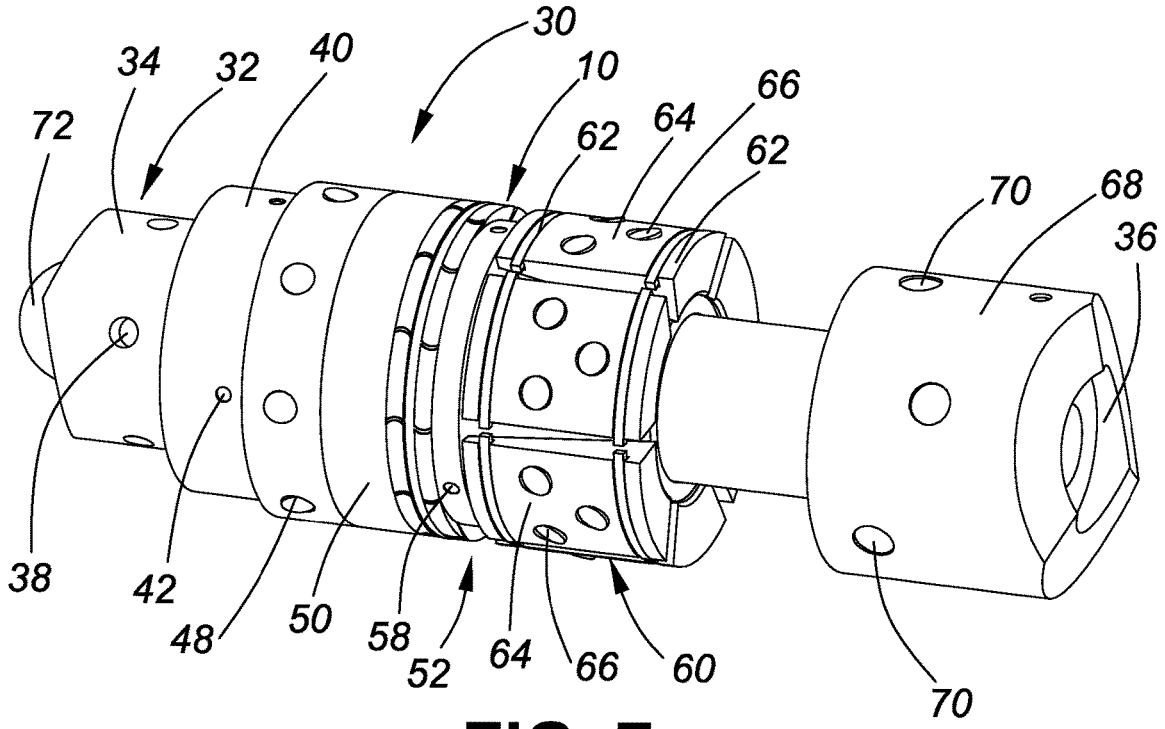
FIG. 7 is a perspective view of the frac plug shown in FIG. 6 in a packer-set condition.

FIG. 7 is a perspective view of the composite frac plug 30 shown in FIG. 6 in the packer-set condition. In this condition, the ceramic inserts 48 bite and grip the casing of a cased well bore in which the composite frac plug 30 is set. The ceramic slip inserts 66 likewise bite and grip the casing to keep the composite frac plug 30 firmly anchored in the cased well bore.

Figure 7A:
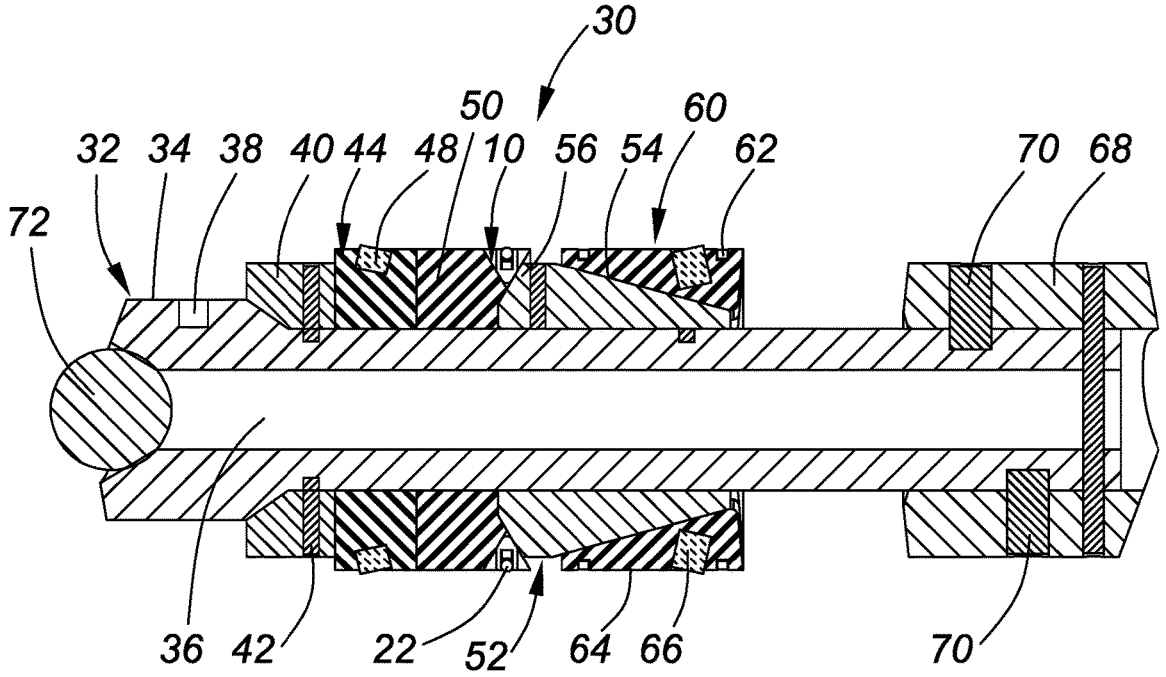
FIG. 7A is a cross-sectional view of the frac plug shown in FIG. 7.

FIG. 7A is a cross-sectional view of the frac plug shown in FIG. 7. As can be seen, the outward expansion of the ant-extrusion ring 10 by the anti-extrusion cone 56 forces the anti-extrusion ring 10 against the casing of a cased well bore in which the composite frac plug 30 is set. In the packer-set condition, the elastomeric ring 22 of the anti-extrusion ring 10 provides a back-up seal to the high-pressure seal provided by the main sealing element 50.

Figure 8A:
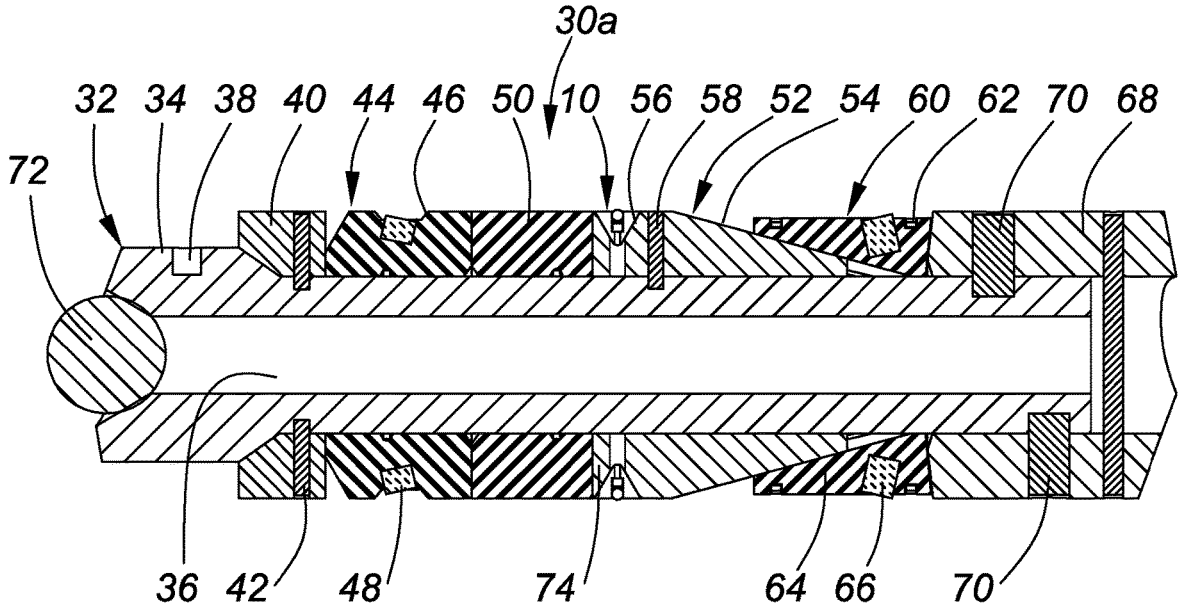
FIG. 8A is a cross-sectional view of another embodiment of a frac plug equipped with the single-set anti-extrusion ring shown in FIG. 1, in the run-in condition.

FIG. 8A is a cross-sectional view of another embodiment of a composite frac plug 30*a* equipped with the single-set anti-extrusion ring shown in FIG. 1, in the run-in condition. All of the elements of the composite frac plug 30*a* have been described above with reference to FIG. 6, with an exception of a sliding cone 74 that slides over the composite mandrel 32 between a downhole end of the main sealing element 50 and the anti-extrusion cone 56 of the slip hub 52. The sliding cone 74 supports an uphole side of the anti-extrusion ring 10 when the composite frac plug 30*a* is in the run-in condition.

Figure 8B:
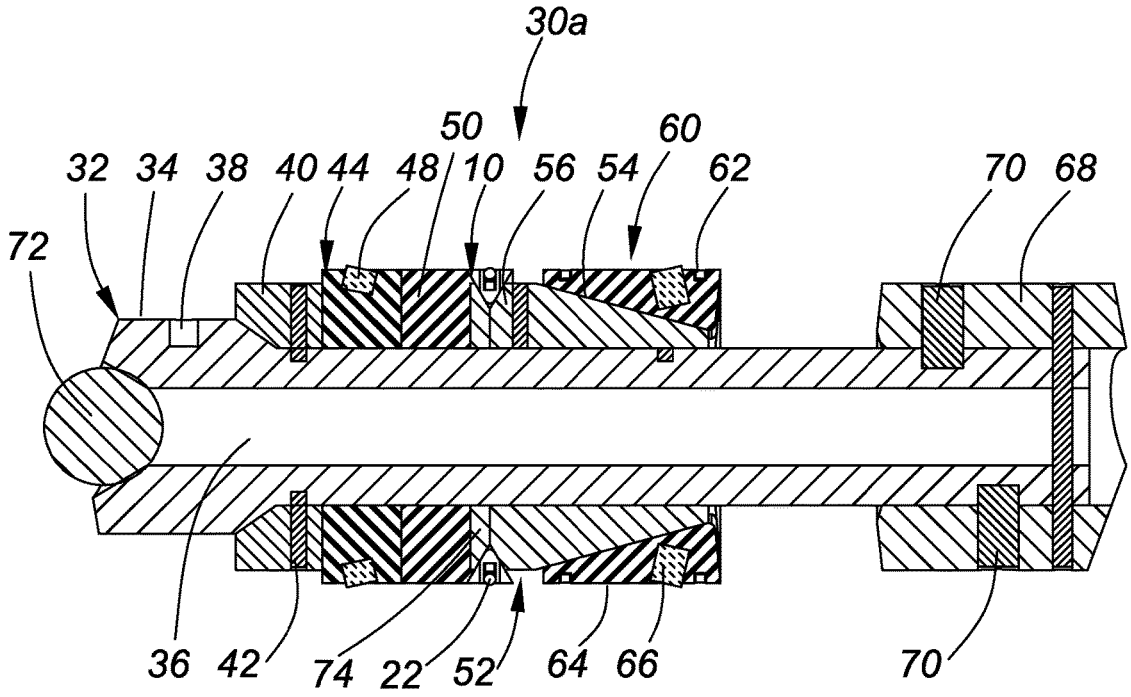
FIG. 8B is a cross-sectional view of the embodiment of a frac plug shown in FIG. 8*a*, in the packer-set condition.

FIG. 8B is a cross-sectional view of the embodiment of the composite frac plug 30*a* shown in FIG. 8*a*, in the packer-set condition. As can be seen, as the composite frac plug 30*a* moves to the packer-set condition, the sliding cone 74 slides downward on the composite mandrel 32 and contacts the anti-extrusion cone 56 of the slip hub 52, forcing the anti-extrusion ring upwardly toward the well casing. The upward movement of the anti-extrusion ring 10 causes the fracture ring 20 to fracture at one or more of the fracture scores 24 as the anti-extrusion ring is expanded outwardly. In the packer-set condition, the sliding cone 74 inhibits any extrusion of the main sealing element 50 under the anti-extrusion ring 10, and in cooperation with the anti-extrusion cone 56 provides a solid base that inhibits movement of the anti-extrusion ring 10 as fluid pressure builds in a cased well bore.

The explicit embodiments of the invention, described above have been presented by way of example only. Other embodiments of the anti-extrusion ring are readily constructed with minor alterations, as will be understood by those skilled in the art. The scope of the invention is therefore intended to be limited solely by the scope of the appended claims.

I claim:

1. An anti-extrusion ring for a main sealing element of a non-retrievable packer, comprising a plurality of ring segments, each ring segment comprises a ring segment notch in a ring segment top surface that receives a rigid fracture ring that is substantially square in cross-section and has a plurality of spaced-apart fracture scores designed to fracture when the anti-extrusion ring is expanded as the packer is shifted from a run-in condition to a packer-set condition, and an elastomeric ring that overlies the fracture ring and is received in a top of the ring segment notch, each ring segment having two ring segment mating faces, each ring segment mating face having a 3-dimensionally curved topology, a first of the mating faces being a mirror image of a second of the mating faces, so that the ring segments fit together to form an anti-extrusion ring without gaps in the run-in condition.

2. The anti-extrusion ring as claimed in claim 1 wherein the fracture ring scores are spaced-apart square notches in a top surface of the fracture ring.

3. The anti-extrusion ring as claimed in claim 1 wherein the anti-extrusion ring is substantially V-shaped in cross-section.

4. The anti-extrusion ring as claimed in claim 3 wherein theanti-extrusion ring has a rounded nadir.

5. A single-set anti-extrusion ring for a main sealing element of a non-retrievable packer comprising a plurality of ring segments that are substantially V-shaped in cross-section and have a rectangular ring segment notch in a top surface thereof, the respective ring segments being held together by a fracture ring comprising a rigid ring that is substantially square in cross-section and has a plurality of spaced-apart fracture scores, the fracture ring being received in the ring segment notch and designed to fracture when the anti-extrusion ring is expanded as the packer is shifted from a run-in condition to a packer-set condition, each ring segment having two ring segment mating faces, each ring segment mating face having a 3-dimensionally curved topology, a first of the mating faces being a mirror image of a second of the mating faces, so that the ring segments fit, together to form an anti-extrusion ring without gaps in the run-in condition, and an elastomeric ring that overlies the fracture ring and is received in a top of the ring segment notch.

6. The anti-extrusion ring as claimed in claim 5 wherein the fracture ring scores are spaced-apart square notches in a top surface of the fracture ring.

7. The anti-extrusion ring as claimed in claim 5 wherein the V-shaped anti-extrusion ring has a rounded nadir.

8. A composite frac plug, comprising:

a composite mandrel with a central passage, the composite mandrel further having an up-hole end and a down-hole end with a mandrel hub on the up-hole end, and an end sub securely affixed to the down hole end;

an elastomeric gripper assembly mounted to the mandrel, the elastomeric gripper assembly having an insert groove with a plurality of circumferentially spaced-apart inserts that bite and grip a casing of a cased wellbore when the composite frac plug is in a set condition;

a main sealing element downhole of the elastomeric gripper assembly;

an anti-extrusion ring downhole of the main sealing element, the anti-extrusion ring comprising a plurality of ring segments that are substantially V-shaped in cross-section and have a rectangular ring segment notch in a top surface thereof, the respective ring segments being held together by a fracture ring that is designed to fracture when the anti-extrusion ring is expanded as the composite frac plug is shifted from a run-in condition to a set condition, each ring segment having two ring segment mating faces, each ring segment mating face having a 3-dimensionally curved topology, a first of the mating faces being a mirror image of a second of the mating faces, so that the ring segments fit together to form an anti-extrusion ring without gaps in the run-in condition;

a slip hub having an anti-extrusion cone downhole of the main sealing element and a slip cone downhole of the anti-extrusion cone; and a slip assembly downhole of the slip hub, the slip assembly comprising a plurality of slips adapted to slide up the slip cone to bite and grip the casing of the cased wellbore when the composite frac plug is shifted from the run-in condition to the set condition.

9. The composite frac plug as claimed in claim 8 further comprising an elastomeric ring that overlies the fracture ring and is received in a top of a ring segment notch that is adapted to receive the fracture ring.

10. The composite frac plug as claimed in claim 9 wherein the fracture ring comprises a rigid ring that is substantially square in cross-section and has a plurality of spaced-apart fracture ring scores.

11. The composite frac pluq as claimed in claim 10 wherein the fracture ring scores are spaced-apart square notches in a top surface of the fracture ring.

12. The composite frac plug as claimed in claim 8 wherein the inserts in the elastomeric gripper assembly comprise ceramic inserts.

13. The composite frac plug as claimed in claim 8 wherein the interconnected slips are bound together on the composite mandrel by slip retainer bands that shear as the composite frac plug is shifted from the run-in condition to the set condition.

14. The composite frac plug as claimed in claim 8 wherein the slips comprise composite slips with ceramic slip inserts that bite and grip the casing of the cased wellbore when the composite frac plug is shifted from the run-in condition to the set condition.

15. The composite frac plug as claimed in claim 8 wherein the slip hub is secured to the composite mandrel by slip hub retainer pins that are adapted to shear when the composite frac plug is shifted from the run-in condition to the set condition.

* * * * *